US006657604B2

(12) United States Patent
Huang et al.

(10) Patent No.: US 6,657,604 B2
(45) Date of Patent: Dec. 2, 2003

(54) ENERGY RECOVERY CIRCUIT FOR PLASMA DISPLAY PANEL

(75) Inventors: Jih-Fon Huang, Chupei (TW); Yi-Min Huang, Taipei (TW); Sun-Chen Yang, Taipei Hsien (TW)

(73) Assignee: Au Optronics Corp., Hsinchu (TW)

( * ) Notice: Subject to any disclaimer, the term of this patent is extended or adjusted under 35 U.S.C. 154(b) by 235 days.

(21) Appl. No.: 09/952,853

(22) Filed: Sep. 10, 2001

(65) Prior Publication Data

US 2002/0030642 A1 Mar. 14, 2002

(30) Foreign Application Priority Data

Sep. 13, 2000 (TW) ..... 89118761 A

(51) Int. Cl.[7] ..... G09G 3/28
(52) U.S. Cl. ..... 345/60; 345/211; 315/169.3
(58) Field of Search ..... 345/60, 55, 61, 345/62, 211, 212, 204; 315/169.3, 169.1

(56) References Cited

U.S. PATENT DOCUMENTS 5,828,353 A * 10/1998 Kishi et al. ..... 345/55
6,150,999 A * 11/2000 Chen et al. ..... 345/60
6,175,192 B1 * 1/2001 Moon ..... 315/169.3
6,538,627 B1 * 3/2003 Whang et al. ..... 345/60
2002/0033806 A1 * 3/2002 Vossen et al. ..... 345/204
2003/0025459 A1 * 2/2003 Lee et al. ..... 315/169.3
2003/0030632 A1 * 2/2003 Choi ..... 345/211
2003/0071578 A1 * 4/2003 Lee et al. ..... 315/169.3

* cited by examiner

*Primary Examiner*—Amare Mengistu
(74) *Attorney, Agent, or Firm*—Ladas & Parry

(57) ABSTRACT

An energy recovery circuit of a plasma display panel is disclosed, which can drive the sustain electrode of the plasma display panel during the sustain period. The energy recovery circuit includes a voltage source which can store electrical energy, a first channel for raising the voltage of the sustain electrode to high potential, a second channel for pulling the voltage of the sustain electrode down to ground, and other auxiliary circuits. When the first channel is turned on, the voltage source can transmit electrical energy to the sustain electrode. When the second channel is turned on, the voltage source retrieves the electrical energy from the sustain electrode. Thereby the sustain electrode is driven between high potential and ground. Moreover, the first channel and the second channel can share a part of common channel.

18 Claims, 6 Drawing Sheets

ENERGY RECOVERY CIRCUIT FOR PLASMA DISPLAY PANEL

BACKGROUND OF THE INVENTION

1. Field of the Invention

The present invention relates in general to a technology for plasma display panel, and more particularly to an energy recovery circuit for a plasma display panel.

2. Description of the Related Art

A PDP device, which displays images by accumulating charges by electrode discharge, is an attention-getting flat display since it can have a large screen size display a full-color image.

FIG. 1 is a cross-sectional diagram of a conventional PDP cell, in which the PDP is triple-electrode type. As shown in the drawing, the PDP is basically constituted by two glass substrates 1 and 7. Inert gas such as Ne, Xe is filled in the cavity formed between the glass substrates 1 and 7. Two electrodes including a sustain electrode X and a sustain electrode Yi are disposed parallel to each other on the glass substrate 1. A dielectric layer 3 and a protective film 5 are formed covering the sustain electrode X and the sustain electrode Yi. Address electrodes Ai, which are perpendicular to the sustain electrode X and the sustain electrode Yi, are disposed on the glass substrate 7. Partition wall 8 is used to isolate each PDP cell. Fluorescent material is placed between the partition walls to luminesce during the discharge process.

FIG. 2 is a block diagram of a conventional PDP device. As shown in the drawing, the PDP 100 is driven by the sustain electrodes Y1~Yn and sustain electrode X parallel to each other and the address electrodes A1~Am across thereon. The reference numeral 10 indicates the display unit of the PDP 100. Partition wall 8 is used to isolate each display unit 10.

Besides the PDP 100, the PDP device includes the control circuit 110, the Y scan driver 112, the X common driver 114 and the address driver 116. The control circuit 110 can generate the timing information necessary for every driver according to the external clock signal CLOCK, the video data signal DATA, the vertical synchronous signal VSYNC and the horizontal synchronous signal HSYNC. The clock signal CLOCK represents the data-transmitting clock. The video data signal DATA represents the display data. The vertical synchronous signal VSYNC and the horizontal synchronous signal HSYNC are used to define the timing of a single frame and a single scanning line. The control circuit 110 generates every clock and data to be displayed, which are sent to the corresponding drivers to generate the signals needed to drive the electrodes.

FIG. 3 is diagram of driving the PDP to display a frame in the prior art. A frame is normally divided into several sub-fields. For instance, the frame of FIG. 3 is divided into 8 sub-fields SF1~SF8. Each sub-field is used to display the corresponding gray scales on all scanning lines. For example, 8 sub-fields can be used when 256 levels of gray scales corresponding to 8 bits are to be displayed. Each sub-field is constituted by three operating periods, i.e., the reset periods R1~R8, the address periods A1~A8 and the sustain periods S1~S8. The residual charge left from the last field display is cleaned in the reset period. The wall charge is accumulated in the display cell through address discharge in the address period. The accumulated wall charge is sustained to maintain the display status in the sustain period.

All display units on the PDP are simultaneously processed in the reset period R1~R8 and the sustain period S1~S8. However, address operation is sequentially performed for the display units on the sustain electrodes Y1~Yn in the address periods A1~A8.

FIG. 4 is the timing diagram of the control signals of the sustain electrodes X and Yi on a single sub-field of FIG. 3 such as SF1. After finishing the reset operation of all scanning lines, the address period starts. In the address period, i.e., A1, the X common driver 114 controls the sustain electrode X to output the voltage Vs. The scanning lines corresponding to the electrodes Y1, Y2, Y3, . . . , Yn sequentially output the address pulses AP including display data to the address electrodes A1, A2, . . . , Am through the address driver 116. Therefore, a transient discharge occurs on the display unit 10 corresponding to the data to be displayed, and the wall charge is accumulated in the display unit 10. After processing all of the scanning lines, the "data to be displayed" can be stored in the corresponding display unit 10 in the form of accumulated wall charge.

After finishing the address period, the sustain period (i.e., S1) starts. In the sustain period, the Y scan driver 112 and the X common driver 114 alternately send the sustain pulses to all of the sustain electrodes Yi and the common sustain electrode X. As shown in FIG. 4, a sustain pulse Xsus having a voltage level Vs is sent to the sustain electrode X. This action will be repeated during the sustain period of the sub-field. Moreover, this action involves all of the display units 10, but only the display units 10 that have accumulated wall charges through the address discharge during the address period keep luminescing during the sustain period.

Accordingly, the X common driver 114 periodically generates a sustain pulse Xsus during the sustain period. Normally, the sustain pulse Xsus is a signal of high frequency and high voltage, thus causing a considerable power consumption. There are many energy-recovery structures designed for this driving circuit currently. FIG. 5 is a circuit diagram of a prior-art energy-recovery structure for PDP driving circuit. As shown in the drawing, Cp indicates the capacitor-like load corresponding to the display units 10 of the PDP 100. The capacitor Cp has one end connected to the Y scan driver 112. The X common driver 114 includes the MOS transistors T1, T2, T3 and T4, the inductance element 61 and the capacitor C3. The capacitor C3 is an element storing and releasing energy. The transistors T3 and T4 are alternatively opened to raise up or pull down the voltage of the sustain electrode X. The operation is briefly described below.

When the voltage of the sustain electrode X changes from 0 volts to Vs, i.e., the rising edge of the sustain pulse Xsus, the voltage of the capacitor C3 maintains at Vs/2, and the voltage of the coil is 0 volts. At this time, the transistor T3 is turned on, and the voltage Vs/2 of the capacitor is applied to one end of the coil 61. Thus a current occurs on the coil 61 and the voltage of the sustain electrode X on the other end of the coil rises up. Since a counter electromotive force exists on the coil 61, the voltage of the sustain electrode X, i.e., the other end of the coil, can theoretically be raised to Vs. However, the voltage cannot rise up to Vs in practice due to loss. The voltage of the sustain electrode X is raised to Vs by turning the transistor T1 on if the voltage of the sustain electrode X is a little lower than Vs. That the voltage of the sustain electrode X suddenly rises to Vs will cause the problem of electromagnetic interference.

On the other hand, when the voltage of the sustain electrode X changes from Vs to 0 volts, i.e., the falling edge of the sustain pulse Xsus, the voltage of the coil is Vs. At this time, the transistor T4 is turned on, and the voltage Vs/2 of the capacitor C3 is applied to one end of the coil 61. Thus a reverse current occurs on the coil 61, and the voltage of the sustain electrode X on the other end of the coil 61 falls down to 0 volts. However, the voltage of the sustain electrode X does not fall to 0 volts in practice due to loss. The voltage of the sustain electrode X can fall down to 0 volts by turning the transistor T2 on if the voltage of the sustain electrode X is a little higher than 0 volts. That the voltage of the sustain electrode X suddenly falls to 0 volts will also cause the problem of electromagnetic interference.

In order to improve on the drawbacks for the above energy-recovery structure, U.S. Pat. Nos. 5,438,290 and 5,828,353 disclose using a capacitor as a device storing and releasing energy to reduce the power consumption for repeatedly driving the sustain electrode X.

SUMMARY OF THE INVENTION

Accordingly, an object of the present invention is to provide an energy-recovery driving circuit which is suitable for using in the driver of a PDP. The energy-recovery circuit can avoid the problem of electromagnetic interference since the transistors of the circuit switch are at zero voltage.

According to the above object, the energy-recovery driving circuit of this invention alternatively applies a driving potential Vs and a reference potential V0 to the sustain electrode X on a PDP. The sustain electrode connects to the capacitor-like load corresponding to the display units. The energy-recovery driving circuit includes a first voltage source for providing the driving potential; a second voltage source for providing a first potential which is lower than the driving potential and storing electrical energy; a first channel, including a first inductance element connected between the first voltage source and the electrode, for providing electrical energy to the electrode while the potential of the electrode changes from the reference potential to the driving potential; a second channel, including a second inductance element connected between the second voltage source and the electrode, for providing electrical energy by the electrode and storing the electrical energy in the second voltage source while the potential of the electrode changes from the driving potential to the reference potential; a first switch, connected between the first voltage source and the electrode, for connecting the first voltage source to the electrode while the potential of the electrode changes from the reference potential to the driving potential; and a second switch, connected between the second voltage source and the electrode, for connecting the electrode to the reference potential while the potential of the electrode changes from the driving potential to the reference potential. The first channel further includes a third switch for controlling the turn-on of the first channel. The second channel further includes a fourth switch for controlling the turn-on of the second channel.

Furthermore, the first switch can be replaced by a unidirectional conductive element connected between the first voltage source and the electrode to control the charge direction. The second switch can be replaced by a second unidirectional conductive element connected between the second voltage source and the electrode to control the discharge direction.

The first channel and the second channel may share a common channel. In other words, the first inductance element and the second inductance element can be replaced by a single inductance element. The common channel further includes a current direction control device for setting the conducting direction of the first channel and the conducting direction of the second channel.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

First Embodiment

Figure 6A:
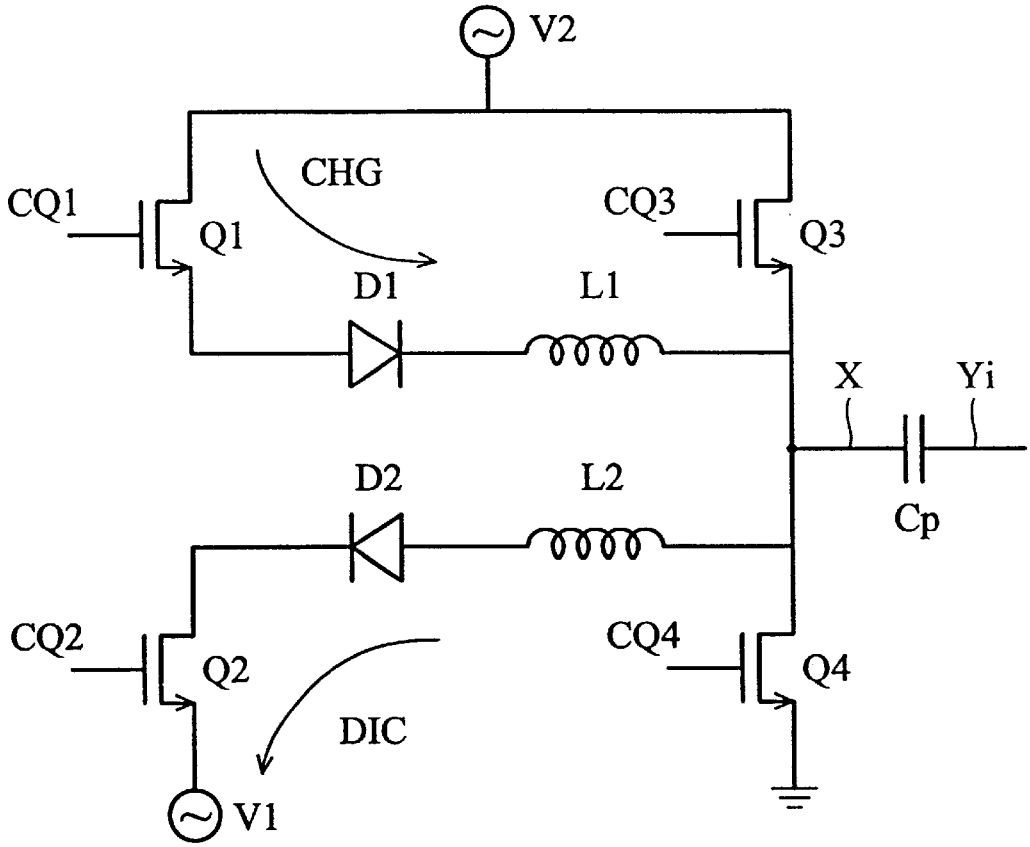
FIG. 6A is a circuit diagram of the energy-recovery structure of the X common driver according to the first embodiment of this invention.

FIG. 6A is a circuit diagram of the energy-recovery structure of the X common driver according to this first embodiment. In FIG. 6A, the symbol "X" represents the sustain electrode X, the symbol "Yi" represents the sustain electrodes Yi, and the symbol "Cp" represents the capacitor-like load corresponding to the display units in the PDP. As shown in the drawing, voltage sources V1 and V2 are disposed in the X common driver, in which the voltage source V2 supplies the voltage Vs and the voltage source V1 provides a voltage lower than Vs/2. Moreover, in this embodiment, the voltage source V1 can retrieve electrical energy. Since the current in the inductance elements L1, L2 can not instantly change its direction, the electrode X can be charged to the reference potential Vs to turn on the transistor Q3 while charging through the path CHG, and the electrode X can be discharged to the reference potential GND to turn on the transistor Q4 while discharging through the path DIC.

The X common driver can change the potential of the sustain X from 0 volts (ground) to Vs or from Vs to 0 volts the first channel CHG and the second channel DIC as shown in FIG. 6A. The first channel CHG, which includes a MOS transistor Q1 controlled by the signal CQ1, a diode D1 and the inductance element L1, is a charge path for controlling the voltage source V2 to release electrical energy to the sustain electrode X. The second channel DIC, which includes a MOS transistor Q2 controlled by the signal CQ2, a diode D2 and the inductance element L2, is a retrieving path for controlling the sustain electrode X to retrieve electrical energy and store the electrical energy in the voltage source V1.

Figure 1:
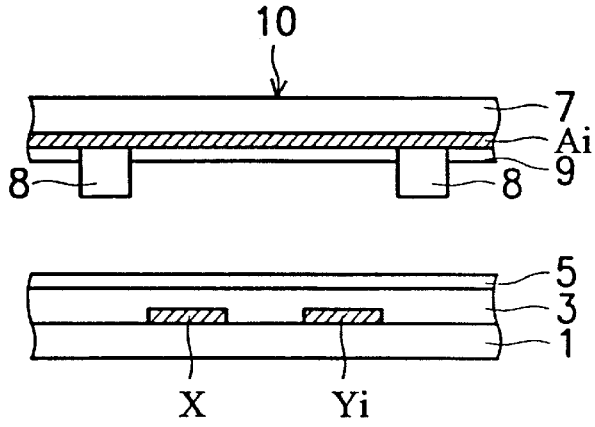
FIG. 1 ( PRIOR ART )
FIG. 1 is a cross-sectional diagram of the display cell in a conventional PDP.
Figure 2:
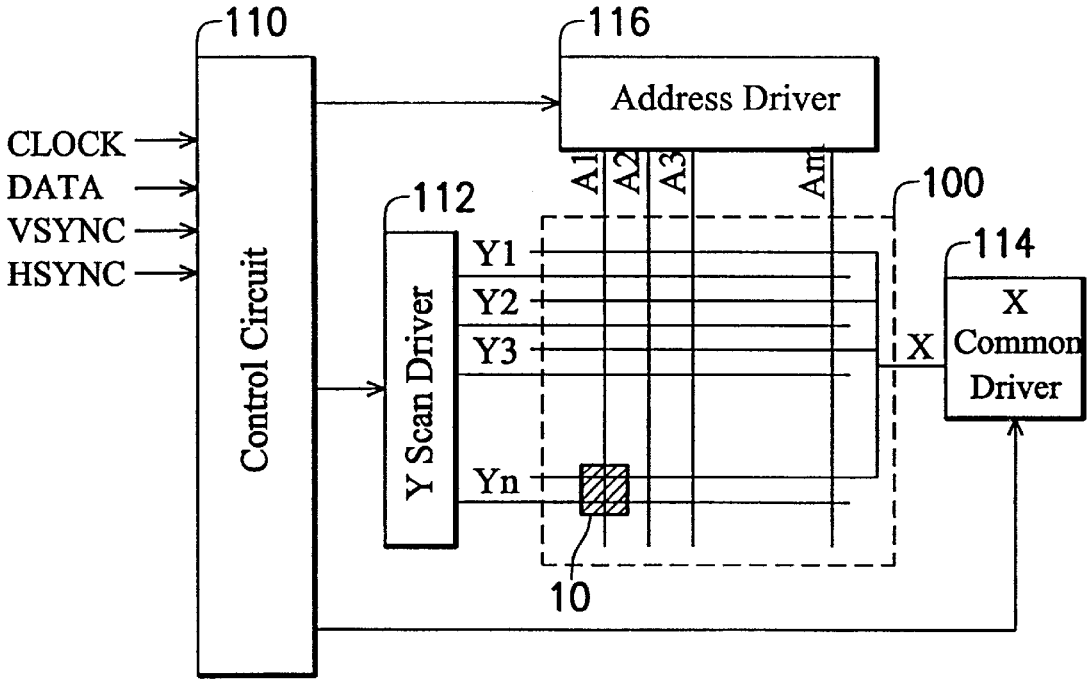
FIG. 2 ( PRIOR ART )
FIG. 2 is a block diagram of a conventional PDP device.
Figure 3:
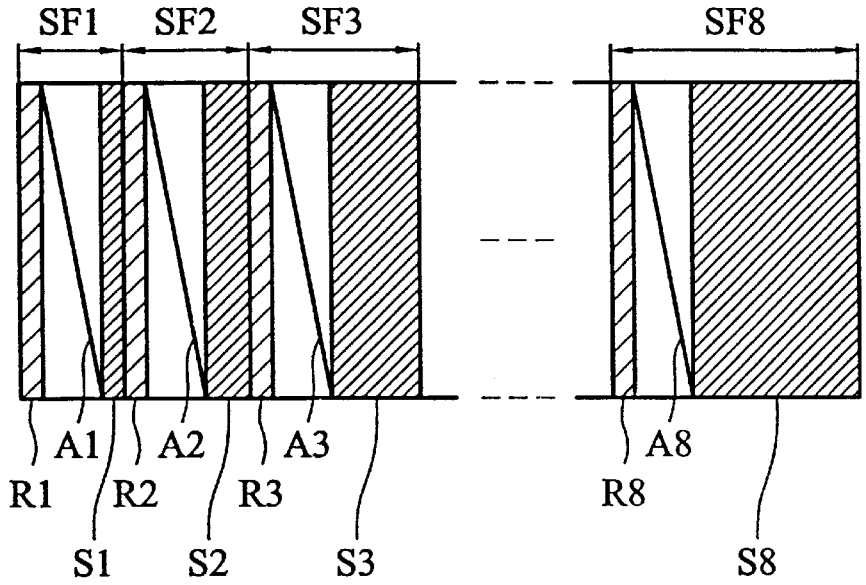
FIG. 3 ( PRIOR ART )
FIG. 3 is a diagram illustrating the operation of showing a frame basing on the driving technology of a conventional PDP.
Figure 4:
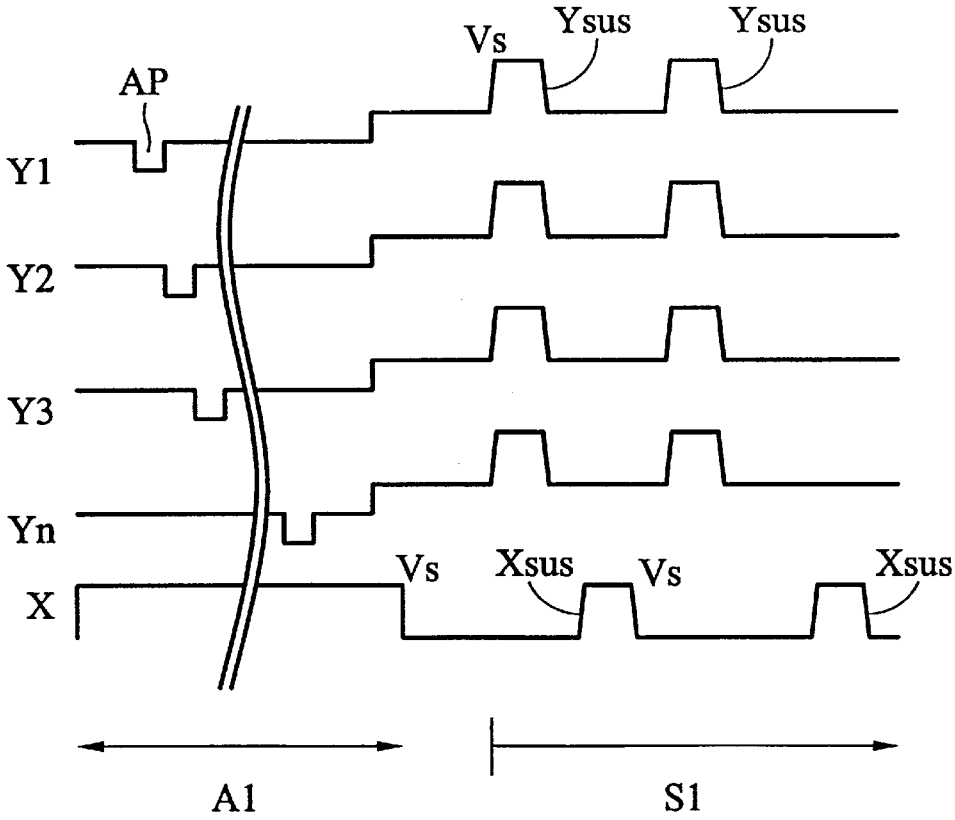
FIG. 4 ( PRIOR ART )
FIG. 4 is a timing diagram of the control signal on the sustain electrodes X and Yi in a single sub-field such as SF1 of FIG. 3.
Figure 5:
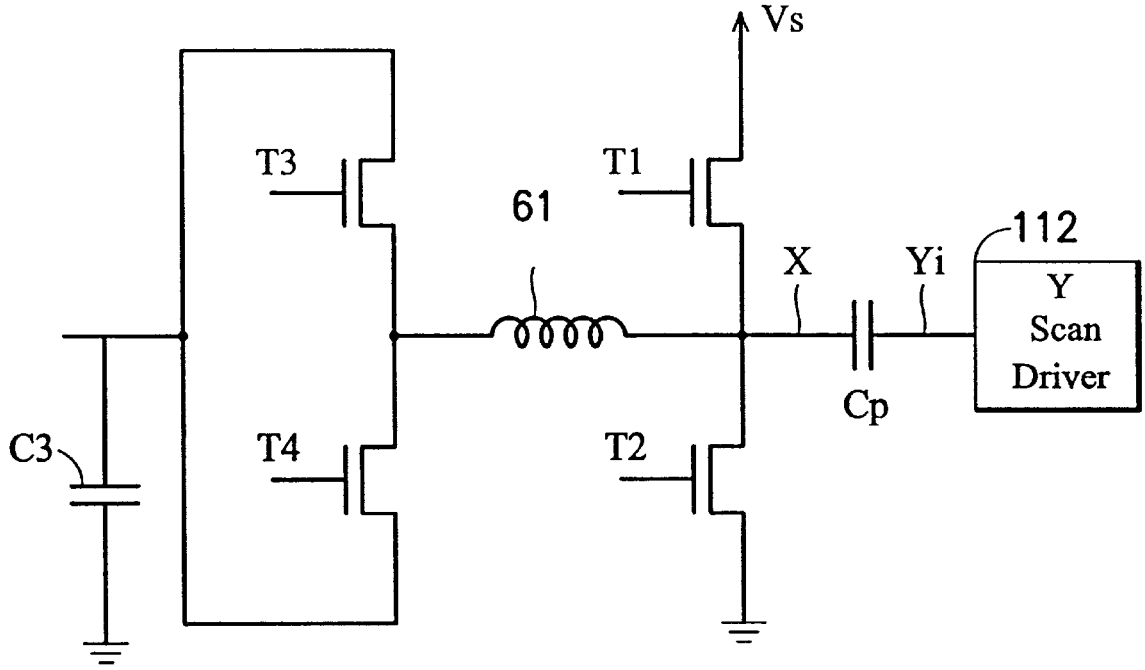
FIG. 5 ( PRIOR ART )
FIG. 5 is a circuit diagram of the energy-recovery structure for a prior-art PDP driving circuit.

The function of the elements in the first path CHG is described below. The inductance element L1 functions similar to the inductance element 61 of FIG. 5 to raise the voltage of the sustain electrode X to Vs. The diode D1 is used to ensure the direction of the charge current. The MOS transistor Q1 is controlled by the control signal CQ1 to control the turn-on time of the first channel CHG. When the first channel CHG is turned on, the voltage of the sustain electrode X gradually rises to Vs and the body diode included in the MOS transistor Q3 is turned on so that the voltage of the sustain electrode X is fixed at Vs. At this time, a control signal CQ3 is applied to turn on the MOS transistor Q3, the MOS transistor Q3 is zero-voltage switching, thus the problem of electromagnetic interference existed in the prior art of FIG. 5 can be avoided.

Next, the function of the elements in the second path DIC is described below. The inductance element L2 functions similar to the inductance element 61 of FIG. 5 to retrieve electrical energy to pull down the voltage of the sustain electrode X to 0 volts. The diode D2 is used to ensure the direction of retrieving electrical energy, that is, the current direction of retrieving electrical energy from the sustain electrode X to the voltage source V1. A control signal CQ2 is used to control the MOS transistor Q2 to control the turn-on time of the second channel. When the second channel DIC is turned on, the sustain electrode X releases the electrical energy to the voltage source V1 through the second channel DIC. When the voltage of the sustain electrode X gradually falls down to 0 volts (ground), the body diode included in the MOS transistor Q4 is turned on, thus the voltage of the sustain electrode X is fixed at 0 volts. At this time, a control signal CQ4 is used to turn on the MOS transistor Q4, the NOS transistor Q4 is zero-voltage switching, thus the problem of electromagnetic interference existed in the prior art of FIG. 5 can be avoided.

Figure 6B:
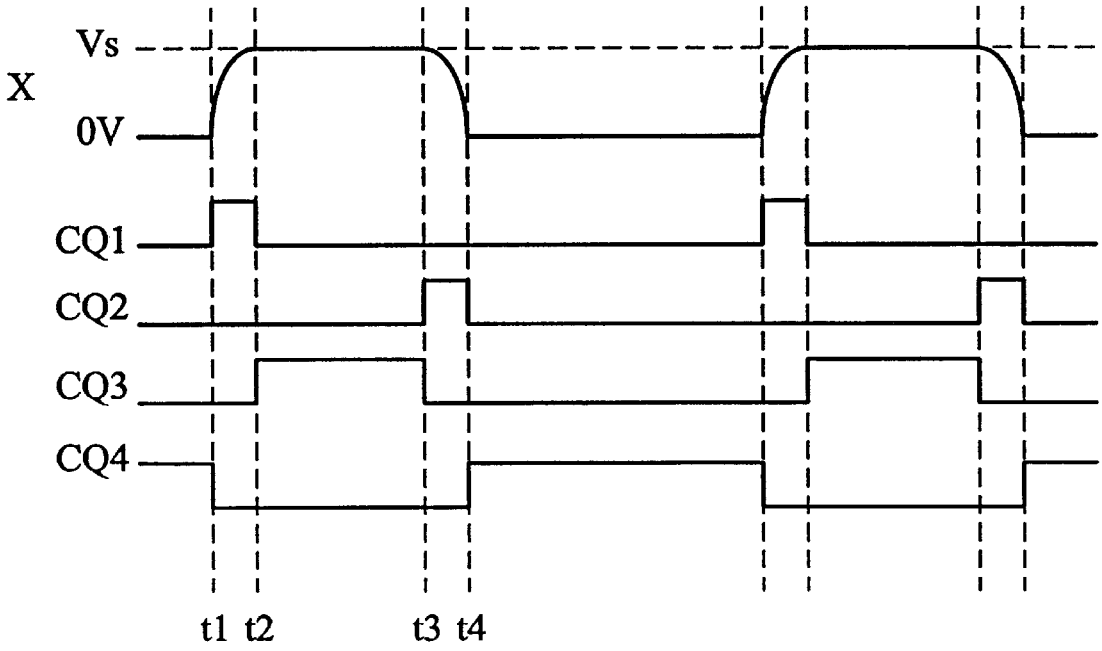
FIG. 6B is a diagram illustrating the waveforms of the control signals in the circuit of FIG. 6A.

Referring to FIG. 6A, the control signals CQ1, CQ2, CQ3 and CQ4 for controlling the MOS transistors Q1, Q2, Q3 and Q4 are used to drive the sustain electrode X. FIG. 6B is the waveform diagram of the control signals CQ1, CQ2, CQ3 and CQ4 and the voltage of the sustain electrode X in FIG. 6A. As shown in the drawing, the voltage of the sustain electrode X is 0 volts before the time t1. At the time t1, the control signal CQ1 turns on the MOS transistor Q1, the first channel CHG is turned on. Therefore the voltage of the sustain electrode X changes from 0 volts to Vs through the first channel CHG. The body diode included in the MOS transistor Q3 is turned on, thus the voltage of the sustain electrode X is fixed at Vs. At the time t2, the control signal CQ3 turns on the MOS transistor Q3. The voltage source V2 directly charges the sustain electrode X to maintain the voltage of the sustain electrode X at Vs.

Next, at the time t3, the control signal CQ2 turns on the MOS transistor Q2, thus the voltage of the sustain electrode X is pulled down from Vs to 0 volts. The body diode included in the MOS transistor Q4 is turned on therefore the voltage of the electrode X is fixed at 0 volts. At the time t4, the control signal CQ4 turns on the MOS transistor Q4 to maintain the voltage of the sustain electrode X at 0 volts.

Accordingly, the control signals CQ1, CQ2, CQ3 and CQ4 can be used to alternatively open the channels, so that the sustain electrode X is repeatedly driven between Vs and 0 volts to meet the output requirement of the X common driver. Moreover, the rising time and the falling time of the voltage of the sustain electrode X can be adjusted by changing the parameters of the first channel CHG and the second channel DIC. The object for recovery electrical energy can be achieved by repeatedly retrieving the electrical energy.

Second Embodiment

In the first embodiment, four MOS transistors Q1, Q2, Q3 and Q4 controlled by various control signals are used to drive the sustain electrode X. In this embodiment, two diodes are used to replace the MOS transistors Q3 and Q4 used in the first embodiment.

Figure 7A:
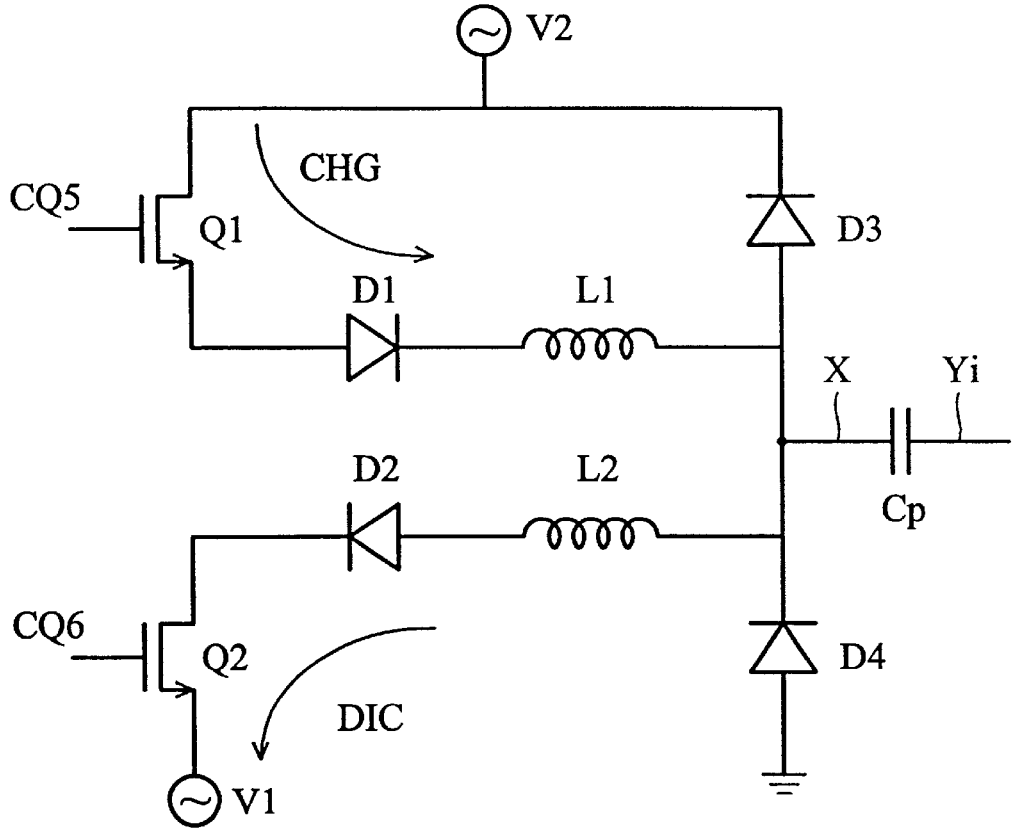
FIG. 7A is a circuit diagram of the energy-recovery structure of the X common driver according to the second embodiment of this invention.

FIG. 7A is the circuit diagram of the energy-recovery structure of the X common driver in this embodiment. As shown in FIG. 7A, the diodes D3 and D4 are used to replace the MOS transistors Q3 and Q4 of FIG. 6A. The positive electrode and the negative electrode of the diode D3 are respectively connected to the sustain electrode X and the voltage source V2. The positive electrode and the negative electrode of the diode D4 are respectively connected to the ground and the sustain electrode X.

Figure 7B:
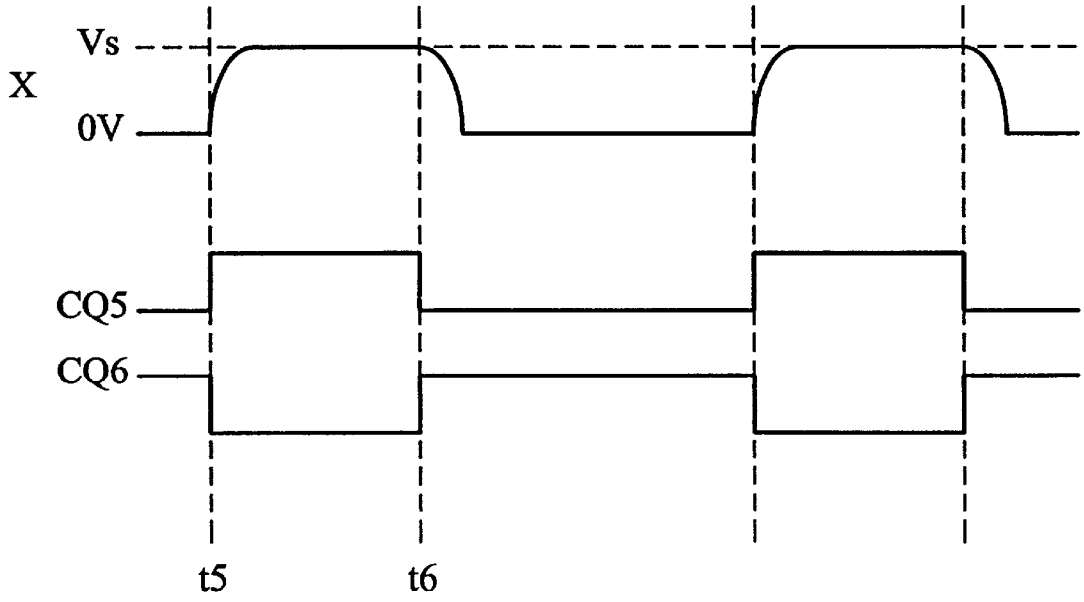
FIG. 7B is a diagram illustrating the waveforms of the control signals in the circuit of FIG. 7A.

Since the diodes D3 and D4 need no control signal, only the control signal CQ5 used to control the MOS transistor Q1 and the control signal CQ6 used to control the MOS transistor Q2 are required in FIG. 7A. FIG. 7B is the waveform diagram of the control signals CQ5 and CQ6 of FIG. 7A. As shown in the drawing, the control signal CQ5 is used to control driving the sustain electrode X from 0 volts to Vs, and the control signal CQ6 is used to control driving the sustain electrode X from Vs to 0 volts.

At the time t5, the control signal CQ5 turns on the MOS transistor Q1 so that the first channel is turned on. The voltage source V2 releases the electrical energy to the sustain electrode X through the first channel CHG. The voltage of the sustain electrode X gradually rises to Vs, then the diode D3 is turned on, and the voltage of the sustain electrode X is fixed at the voltage Vs of the voltage source V2. Therefore, the problem of electromagnetic interference as caused by sudden switching of voltage in the prior art of FIG. 5 will not occur. At the time t6, the control signal CQ6 turns on the MOS transistor Q2, so that the second channel DIC is turned on. The sustain electrode X retrieves the electrical energy to the voltage source V1 through the second channel DIC. The voltage of the sustain electrode X gradually falls down to 0 volts, then the diode D4 is turned on, and the voltage of the sustain electrode X is fixed at 0 volts. Alternatively controlling the turn-on status of the first channel CHG and the second channel DIC can alternatively drive the sustain electrode X between Vs and 0 volts to meet the output requirement of the X common driver. The object for recovery electrical energy can be achieved by repeatedly retrieving the electrical energy. Moreover, the number of transistors can be reduced since the diodes are used to replace the MOS transistors used in the first embodiment. The NMOS transistors Q3 and Q4 used in the first embodiment can be used in parallel with the diodes D3 and D4 used in this embodiment to provide the same effect.

Third Embodiment

In the first embodiment, the electric energy is transmitted and retrieved through the first channel CHG and the second channel DIC which are established independently. In this embodiment, the first channel CHG and the second channel DIC share a part of common channel in this embodiment. Further, in order to reduce the number of elements, a single inductance element is used to replace the inductance element L1 of the first channel CHG and the inductance element L2 of the second channel DIC.

Figure 8A:
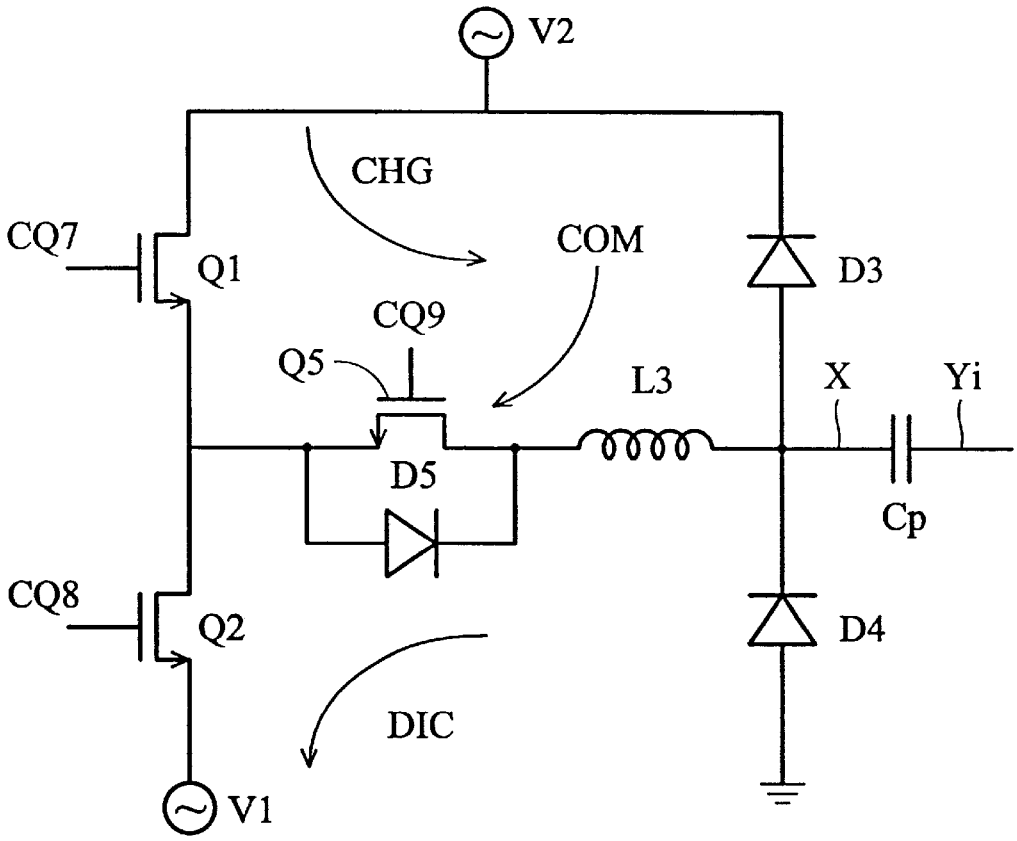
FIG. 8A is a circuit diagram of the energy-recovery structure of the X common driver according to the third embodiment of this invention.

FIG. 8A is the circuit diagram of the energy-recovery structure for the X common driver of this embodiment. As shown in the drawing, the difference of this embodiment to the first embodiment and the second embodiment is that the first channel CHG and the second channel DIC share a common channel COM. The common channel COM includes an inductance element L3 and a current direction control device including a MOS transistor Q5 and a diode D5. In other words, a single inductance element L3 is used to replace the inductance elements L1 and L2 used in the first embodiment and the second embodiment. The MOS transistor Q5 of the current direction control device is controlled by the control signal CQ9. The diode D5 is disposed along the current direction of the first channel CHG. The diode D5 and the MOS transistor Q5 respectively correspond to the conductive directions of the first channel CHG and the second channel DIC. When the MOS transistor Q5 is turned off, the MOS transistor Q1, the diode D5 and the inductance element L3 constitute the first channel CHG. When the MOS transistor Q5 is turned on, the inductance element L3, the MOS transistor Q5 and the MOS transistor Q2 constitute the second channel DIC.

Figure 8B:
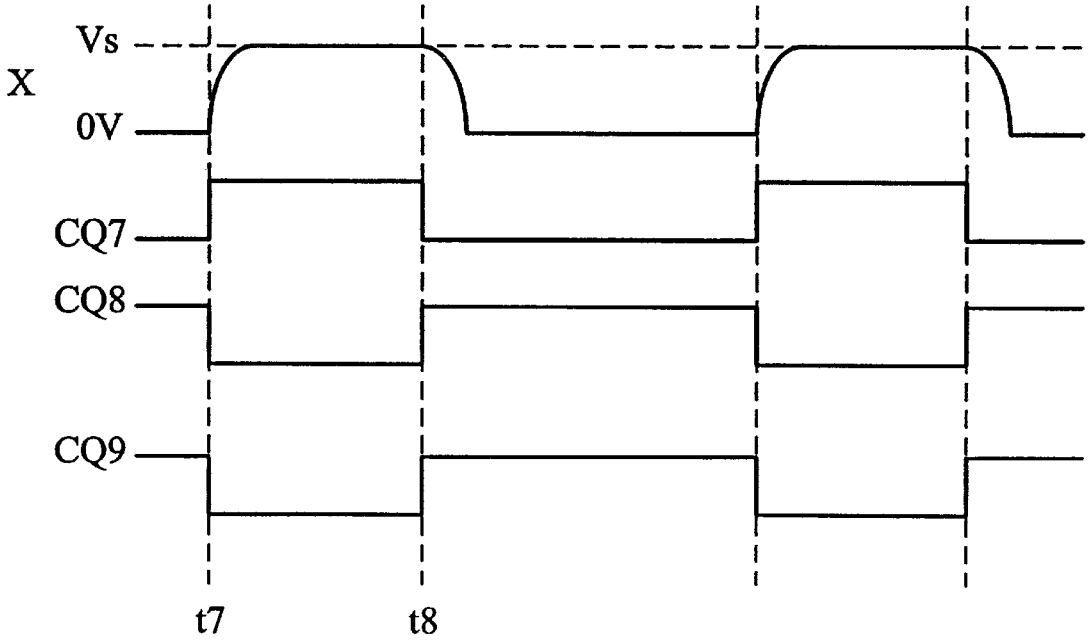
FIG. 8B is a diagram illustrating the waveforms of the control signals in the circuit of FIG. 8A.

FIG. 8B is the waveform diagram for the control signals CQ7, CQ8 and CQ9 of FIG. 8A. The control signals CQ7 and CQ8 are respectively used to control the MOS transistors Q1 and Q2. It should be noted that the control signals CQ8 and CQ9 are synchronous. As shown in the drawing, at the time t7, the control signal CQ7 turns on the MOS transistor Q1, and the MOS transistor Q5 is turned off so that the first channel CHG is turned on. The voltage source V2 releases the electrical energy to the sustain electrode X through the first channel CHG. The voltage of the sustain electrode X gradually rises to Vs, then the diode D3 is turned on and the voltage of the sustain electrode X is fixed at the voltage Vs of the voltage source V2. Therefore, the problem of electromagnetic interference caused by sudden switching of voltage in the prior art of FIG. 5 will not occur in this embodiment. Next, at the time t8, the control signal CQ8 turns on the MOS transistor Q2 and the control signal CQ9 turns on the MOS transistor Q5 so that the second channel DIC is turned on. The sustain electrode X transmits the electrical energy to the voltage source V1 through the second channel DIC. The voltage of the sustain electrode X gradually falls down to 0 volts, then the diode D4 is turned on and the voltage of the sustain electrode X is fixed at 0 volts. Alternatively controlling the turn-on status of the first channel CHG and the second channel DIC can alternatively change the voltage of the sustain electrode X between Vs and 0 volts to meet the output requirement of the X common driver. The object for recovery electrical energy can be achieved by repeatedly retrieving the electrical energy. Moreover, the number of elements can be reduced by using the common channel COM. It should be noted that although the diodes D3, D4 are used in the circuit of FIG. 8A, they can be replaced by using the MOS transistors Q3 and Q4 or the parallel thereof to constitute the energy-recovery driving circuit of this embodiment.

Finally, while the invention has been described by way of examples and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A driving circuit for driving a plasma display panel, the plasma display panel having a first electrode connected to a capacitor-like load of the plasma display panel, the first electrode being driven between a driving potential and a reference potential which is lower than the driving potential, the driving circuit comprising:

a first voltage source(V1) for providing the driving potential;

a second voltage source (V2) for providing a first potential, wherein the first potential is lower than one half of the driving potential;

a first series circuit including a first inductor(L1) connected to both ends of the first voltage source (V1) and the first electrode, wherein electrical energy stored in the capacitor-like load is supplied by the first voltage source through the first inductor when the first series circuit is made conductive and the potential of the first electrode changes from the reference potential to the driving potential;

a second series circuit including a second inductor(L2) connected to both ends of the second voltage source and the first electrode, wherein electrical energy transmitted to the second voltage source by the capacitor-like load through the second inductor when the second series circuit is made conductive and the potential of the first electrode changes from the driving potential to the reference potential;

a first switch connected to both ends of the first voltage source and the first electrode, wherein the first switch turns on to conduct the first voltage source and the first electrode when the potential of the first electrode changes from the reference potential to the driving potential;

a second switch connected to both ends of the second voltage source and the electrode, the second switch connecting the reference potential and the electrode when the second switch being turned on, and the potential of the electrode is changed from the driving potential to the reference potential.

2. The driving circuit as claimed in claim 1, wherein the first switch and the second switch are MOS transistors.

3. The driving circuit as claimed in claim 1, wherein the first series circuit includes a third switch for controlling the turn-on status of the first series circuit; and the second series circuit includes a fourth switch for controlling the turn-on status of the second series circuit.

4. The driving circuit as claimed in claim 3, wherein the first switch, the second switch, the third switch and the fourth switch are MOS transistors.

5. The driving circuit as claimed in claim 3, wherein the first series circuit further includes a first unidirectional conductive element (D1) for ensuring the current direction of the first series circuit; and the second series circuit further includes a second unidirectional conductive element (D2) for ensuring the current direction of the second series circuit.

6. The driving circuit as claimed in claim 5, wherein the first unidirectional conductive element and the second unidirectional conductive element are diodes.

7. The driving circuit as claimed in claim 3, wherein the first switch, the second switch, the third switch and the fourth switch are respectively controlled by control signals, and turned on in sequence of the third switch, the first switch, the fourth switch and the second switch.

8. A driving circuit for driving a plasma display panel, the plasma display panel having a first electrode connected to a capacitor-like load of the plasma display panel, the first being driven between a driving potential and a reference potential which is lower than the driving potential, the circuit comprising:

a first voltage source for providing the driving potential;

a second voltage source for providing a first potential which is lower than one half of the driving potential;

a first series circuit including a first inductor connected to both ends of the first voltage source and the first electrode, wherein electrical energy supplied by the first voltage source is stored in the capacitor-like load through the first inductor when the first series circuit is turned and the potential of the electrode changes from the reference potential to the driving potential;

a second series circuit including a second inductor connected to both ends of the second voltage source and the first electrode, wherein the electrical energy supplied by the capacitor-like load is transmitted to the second voltage source through the second inductor when the second series circuit is turned on so that the potential of the first electrode changes from the driving potential to the reference potential;

a first unidirectional conductive element connected to both ends of the first voltage source and the electrode for providing a unidirectional conduction in a direction from the electrode to the first voltage source;

a second unidirectional conductive element connected to both ends of the second voltage source and the electrode for providing a unidirectional conduction in a direction from the reference potential to the first electrode.

9. The driving circuit as claimed in claim 8, wherein the first unidirectional conductive element and the second unidirectional conductive element are diodes.

10. The driving circuit as claimed in claim 8, wherein the first series circuit includes a first switch for controlling the turn-on status of the first series circuit; and the second series circuit includes a second switch for controlling the turn-on status of the second series circuit.

11. The driving circuit as claimed in claim 10, wherein the first switch and the second switch are MOS transistors.

12. The driving circuit as claimed in claim 8, wherein the first series circuit further includes a third unidirectional conductive element for ensuring the current direction of the first series circuit; and the second series circuit further includes a fourth unidirectional conductive element for ensuring the current direction of the second series circuit.

13. The driving circuit as claimed in claim 12, wherein the first unidirectional conductive element, the second unidirectional conductive element, the third unidirectional conductive element and the fourth unidirectional conductive element are diodes.

14. A driving circuit for driving a plasma display panel, the plasma display having a first electrode coupled to an capacitor-like load, the first electrode being driven between a driving potential and a reference potential which is lower than the driving potential, the driving circuit comprising:

a first voltage source for providing the driving potential;

a second voltage source for providing a first potential, wherein the first potential is lower than one half of the driving potential;

a first series circuit connected between the first voltage source and the electrode, wherein electrical energy supplied by the first voltage source provides is stored in the capacitor-like load through the first series circuit when the first series circuit is turned on so that the potential of the first electrode changes from the reference potential to the driving potential;

a second series circuit connected to both ends of the second voltage source and the electrode, wherein electrical energy supplied by the capacitor-like load provides is transmitted to the second voltage source through the second series circuit when the second series circuit is turned on so that the potential of the first electrode changes from the driving potential to the reference potential; wherein the first series circuit and the second series circuit shares a common series circuit including an inductor and a current direction control device which is used to set a first conducting direction and a second conducting direction respectively corresponding to the first series circuit and the second series circuit;

a first unidirectional conductive element connected to both ends of the first voltage source and the electrode for providing a unidirectional conduction in a direction from the first electrode to the first voltage source;

a second unidirectional conductive element connected to both ends of the second voltage source and the electrode for providing a unidirectional conduction in a direction from the reference potential to the electrode.

15. The driving circuit as claimed in claim 14, wherein the first series circuit includes a first switch independent to the common series circuit for controlling the turn-on status of the first series circuit; and the second series circuit includes a second switch independent to the common series circuit for controlling the turn-on status of the second series circuit.

16. The driving circuit as claimed in claim 15, wherein the current direction control device further comprises a third unidirectional conductive element having a conducting direction corresponding to the first series circuit; and a third switch parallel to the third unidirectional conductive element and has a same on/off status as the second switch.

17. The driving circuit as claimed in claim 16, wherein the first unidirectional conductive element, the second unidirectional conductive element and the third unidirectional conductive element are diodes.

18. The driving circuit as claimed in claim 16, wherein the first switch, the second switch and the third switch are MOS transistors.

* * * * *